US010876363B2

(12) United States Patent
Gonzalez

(10) Patent No.: US 10,876,363 B2
(45) Date of Patent: Dec. 29, 2020

(54) NEGATIVE ANGLE CAPABLE BLASTHOLE DRILLING MAST

(71) Applicant: Caterpillar Global Mining Equipment LLC, Denison, TX (US)

(72) Inventor: Fernando Gonzalez, Sherman, TX (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 211 days.

(21) Appl. No.: 16/100,942

(22) Filed: Aug. 10, 2018

(65) Prior Publication Data

US 2019/0186212 A1 Jun. 20, 2019

Related U.S. Application Data

(63) Continuation-in-part of application No. 15/846,769, filed on Dec. 19, 2017.

(51) Int. Cl.

| | |
|---|---|
| ***E21B 19/084*** | (2006.01) |
| ***E21B 3/02*** | (2006.01) |
| ***E21B 15/04*** | (2006.01) |
| ***E21B 7/02*** | (2006.01) |

(52) U.S. Cl.

CPC ..... *E21B 19/084* (2013.01); *E21B 3/02* (2013.01); *E21B 7/023* (2013.01); *E21B 7/024* (2013.01); *E21B 15/045* (2013.01)

(58) Field of Classification Search

CPC ..... E21B 19/084; E21B 7/023; E21B 15/04; E21B 7/02; B66D 1/36

See application file for complete search history.

(56) References Cited

U.S. PATENT DOCUMENTS

| | | | | |
|---|---|---|---|---|
| 2,081,921 A * | 6/1937 | Gartin | E21B 7/02 91/45 |
| 2,255,241 A * | 9/1941 | Brown | E21B 7/021 173/40 |
| 2,440,427 A | 1/1945 | Bender | |
| 2,766,009 A | 10/1956 | Wilson | |
| 3,719,238 A * | 3/1973 | Campbell | E21B 19/084 173/147 |
| 3,936,034 A | 2/1976 | Larralde | |

(Continued)

FOREIGN PATENT DOCUMENTS

CN 104736769 A 6/2015

*Primary Examiner* — Blake E Michener
*Assistant Examiner* — Theodore N Yao
(74) *Attorney, Agent, or Firm* — Bookoff McAndrews

(57) ABSTRACT

A mast assembly for a mobile drilling machine may comprise: a mast frame including a back, a first side, and a second side, the first side and the second side diverging from the back to form an open front along substantially an entire length of the mast frame; a drill motor assembly movably attached to the mast frame, wherein the drill motor assembly is configured to rotate a drill pipe; and a drill drive assembly configured to drive the motor assembly up and down along a length of the mast frame, the drill drive assembly including: a sheave assembly comprising a plurality of sheaves, wherein the plurality of sheaves include a first sheave aligned generally parallel to the first side of the mast frame and a second sheave aligned generally parallel to the second side of the mast frame.

17 Claims, 6 Drawing Sheets

(56) References Cited

U.S. PATENT DOCUMENTS

| | | | | | |
|---|---|---|---|---|---|
| 3,960,360 | A * | 6/1976 | Elliston | E21B 15/00 | 166/77.4 |
| 4,109,800 | A * | 8/1978 | Howard | E02B 17/00 | 414/22.56 |
| 4,137,974 | A * | 2/1979 | Decker | E21B 3/04 | 173/147 |
| 4,290,495 | A * | 9/1981 | Elliston | E21B 7/02 | 166/77.4 |
| 4,312,413 | A * | 1/1982 | Loftis | E21B 19/084 | 173/140 |
| 4,671,365 | A * | 6/1987 | Back | B66C 23/18 | 173/147 |
| 4,842,250 | A | 6/1989 | Willis et al. | | |
| 5,213,169 | A * | 5/1993 | Heller | E21B 4/20 | 173/185 |
| 5,842,530 | A * | 12/1998 | Smith | E21B 15/003 | 175/162 |
| 6,926,103 | B1 * | 8/2005 | Roodenburg | B66D 3/043 | 175/171 |
| 7,559,380 | B1 * | 7/2009 | McKnight | E21B 19/02 | 166/77.1 |
| 8,997,892 | B2 | 4/2015 | Strange | | |
| 2003/0111232 | A1 * | 6/2003 | Welsh | E21B 19/02 | 166/379 |
| 2008/0047755 | A1 * | 2/2008 | Trevisani | E21B 15/003 | 175/85 |
| 2008/0217037 | A1 * | 9/2008 | Howell | E21B 7/022 | 173/28 |
| 2009/0139731 | A1 * | 6/2009 | Rieder | E21B 19/084 | 166/381 |
| 2018/0066483 | A1 * | 3/2018 | Zanichelli | B66D 1/46 | |
| 2018/0216405 | A1 * | 8/2018 | De Mul | E21B 7/02 | |

* cited by examiner

NEGATIVE ANGLE CAPABLE BLASTHOLE DRILLING MAST

CROSS-REFERENCE TO RELATED APPLICATIONS

This Application is a continuation-in-part of, and claims the benefit of priority to, nonprovisional U.S. patent application Ser. No. 15/846,769, filed Dec. 19, 2017, entitled "PIPE MANAGEMENT SYSTEM FOR NEGATIVE ANGLE DRILLING," which is incorporated herein by reference in its entirety.

TECHNICAL FIELD

The present disclosure relates generally to mobile drilling machines, and more particularly, to a mast assembly for such machines to allow for negative angle drilling.

BACKGROUND

Mobile drilling machines, such as blast hole drilling machines, are typically used for drilling blast holes for mining, quarrying, dam construction, and road construction, among other uses. The process of excavating rock, or other material, by blast hole drilling comprises using the blast hole drill machine to drill a plurality of holes into the rock and filling the holes with explosives. The explosives are detonated causing the rock to collapse and rubble of the collapse is then removed and the new surface that is formed is reinforced. Many current blast hole drilling machines utilize rotary drill rigs, mounted on a mast, that can drill blast holes anywhere from 6 inches to 22 inches in diameter and depths up to 150 feet. Hydraulic cylinders are typically used to raise the mast from a lowered, horizontal position to a raised, vertical position. Such hydraulic cylinders may support the mast at angles between the horizontal position and the vertical position. However, current blast hole drilling machines do not allow for the mast to pivot beyond the vertical position for blast holes to be drilled at negative angles with respect to the vertical position. This is due to the mast being too large and too heavy and the hydraulic cylinders being unable to support the weight of the mast beyond the vertical position.

U.S. Pat. No. 3,960,360 issued to Elliston on Jun. 1, 1976 ("the '360 patent"), describes a mast structure adapted for hoisting and lowering oil well pipe or tubing. The mast structure of the '360 patent includes a frame defined by four tubular upstanding members forming a square and structural cross bracing members to insure rigidity of the structure. The mast structure of the '360 patent further utilizes a pulley system including a pair of crown sheaves, middle sheaves, and a pair of lower sheaves. The pair of crown sheaves are mounted parallel to each other and are of equal diameter. The middles sheaves include two pairs of sheaves, each pair of sheaves including a sheave with a larger diameter and a sheave with a smaller diameter. The lower sheaves are mounted at an angle with respect to each other to facilitate interconnection of a cable and are of equal diameter. Thus, the mast structure of the '360 patent includes a substantial footprint and is not disclosed as capable of pivoting beyond the vertical position for negative angle drilling. The mast assembly of the present disclosure may solve one or more of the problems set forth above and/or other problems in the art. The scope of the current disclosure, however, is defined by the attached claims, and not by the ability to solve any specific problem.

SUMMARY

In one aspect, a mast assembly for a mobile drilling machine may comprise: a mast frame including a back, a first side, and a second side, the first side and the second side diverging from the back to form an open front along substantially an entire length of the mast frame; a drill motor assembly movably attached to the mast frame, wherein the drill motor assembly is configured to rotate a drill pipe; and a drill drive assembly configured to drive the motor assembly up and down along a length of the mast frame, the drill drive assembly including: a sheave assembly comprising a plurality of sheaves, wherein the plurality of sheaves include a first sheave aligned generally parallel to the first side of the mast frame and a second sheave aligned generally parallel to the second side of the mast frame.

In another aspect, a negative angle drilling assembly for a mobile drilling machine may comprise: a mast configured to pivot to each side of a vertical orientation, the mast comprising: a mast frame including a back, a first side, and a second side, the first side and the second side diverging from the back to form an open front along substantially an entire length of the mast frame; a drill motor assembly movably attached to the mast frame, wherein the drill motor assembly is configured to rotate a drill pipe; and a drill drive assembly configured to drive the drill motor assembly up and down along a length of the mast frame, the drill drive assembly including: a sheave assembly comprising a plurality of sheaves, wherein the plurality of sheaves include a first sheave aligned generally parallel to the first side of the mast frame and a second sheave aligned generally parallel to the second side of the mast frame.

In yet another aspect, a mast assembly for a mobile drilling machine may comprise: a mast configured to pivot to each side of a vertical orientation to allow for a negative angle drilling operation, the mast comprising: a mast frame including a back, a first side, and a second side, the first side and the second side diverging from the back to form an open front that is larger than the back, wherein the back, the first side, and the second side are formed by one or more plates extending substantially an entire length of the mast frame; a drill motor assembly movably attached to the mast frame, wherein the motor assembly is configured to rotate a drill pipe; and a drill drive assembly configured to drive the drill motor assembly up and down along a length of the mast frame, the drill drive assembly including: a hydraulic cylinder extending generally parallel with the length of the mast frame; and a sheave assembly comprising a first sheave, a second sheave, a third sheave, a fourth sheave, a fifth sheave, a sixth sheave, a seventh sheave, and an eighth sheave, wherein the first sheave and the second sheave are located at a top of the mast frame, the first sheave is aligned generally parallel to the first side of the mast frame and the second sheave is aligned generally parallel to the second side of the mast frame, and the first sheave includes an outer diameter and the second sheave includes an outer diameter, the outer diameter of the first sheave being less than the outer diameter of the second sheave, wherein the third sheave, the fourth sheave, the fifth sheave, and the sixth sheave are located on the hydraulic cylinder, the third sheave includes an outer diameter, the fourth sheave includes an outer diameter, the fifth sheave includes an outer diameter, and the sixth sheave includes an outer diameter, the outer diameter of the fourth sheave being less than the outer diameter of the third sheave and the outer diameter of the sixth sheave being less than the outer diameter of the fifth sheave, wherein the seventh sheave and the eighth sheave are located at a bottom of the mast frame, the seventh sheave is aligned generally parallel to the first side of the mast frame and the eighth sheave is aligned generally parallel to the second side of the mast frame, and the seventh sheave includes an outer diameter and the eighth sheave includes an outer diameter, the outer diameter of the seventh sheave being less than the outer diameter of the eighth sheave.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
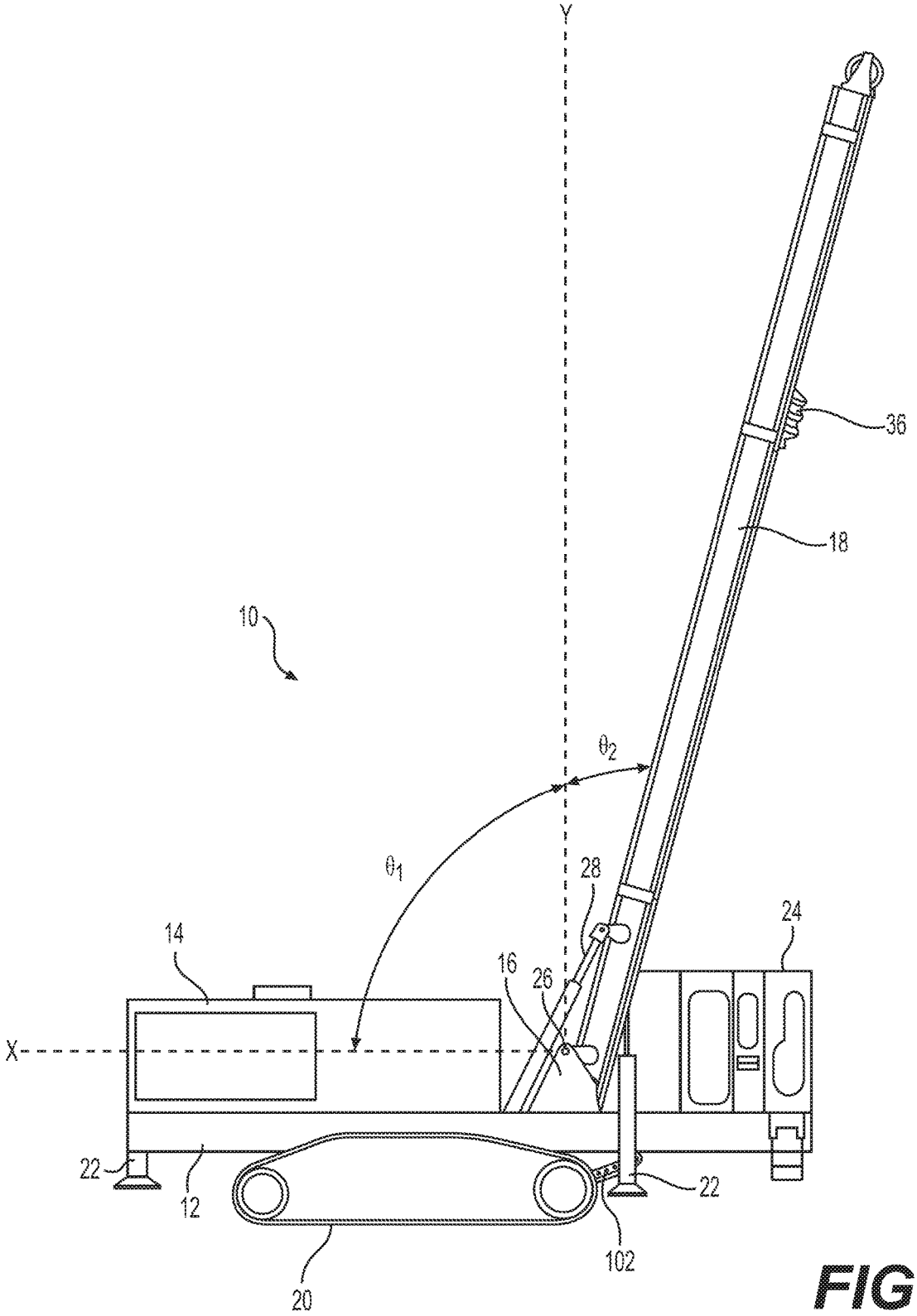
FIG. 1 illustrates a side view of an exemplary mobile drilling machine, according to aspects of the disclosure.

FIG. 1 illustrates a side view of an exemplary mobile drilling machine 10, such as a blast hole drilling machine. Mobile drilling machine 10 may be capable of negative angle drilling, as further discussed below. As shown in FIG. 1, mobile drilling machine 10 may include a frame 12, a machinery housing 14, a coupling assembly 16, and a mast assembly 18. Frame 12 may be supported on a ground surface by a transport mechanism, such as crawler tracks 20. Crawler tracks 20 may allow mobile drilling machine 10 to maneuver about the ground surface to a desired location for a drilling operation. Frame 12 may further include one or more jacks 22. During a drilling operation, the one or more jacks 22 may be lowered to support and level mobile drilling machine 10 on the ground surface. Frame 12 may support the machinery housing 14, which may house motors, gas or diesel engines, air compressors, and any other equipment necessary to power and operate mobile drilling machine 10. Frame 12 may further support an operator cab 24, from which an operator may maneuver and control mobile drilling machine 10.

As further shown in FIG. 1, mobile drilling machine 10 may include a coupling assembly 16 for mounting the mast assembly 18 onto the mobile drilling machine 10. Mast assembly 18 may be attached to the coupling assembly 16 at a pivot 26 and may support a drill motor assembly 36. Mast assembly 18 may further be supported by one or more actuators 28 attached to both the mast assembly 18 and the coupling assembly 16. The one or more actuators 28 may be any suitable actuator, such as a hydraulic cylinder and the like. The mast assembly 18 may rotate about pivot 26 which allows mast assembly 18 to be raised and lowered to a desired drilling angle position by extending or retracting the one or more actuators 28. The mast assembly 18 of the present disclosure may be lightweight and reduced in size such that it may be capable of being set to angles $\theta_2$ beyond the vertical position Y to enable negative angle drilling. As such, mast assembly 18 may be set to any drilling angle $\theta_1$ between ninety degrees (90°) and approximately zero degrees (0°) from the vertical position Y, and any negative drilling angle $\theta_2$ beyond the vertical position Y.

Figure 2:
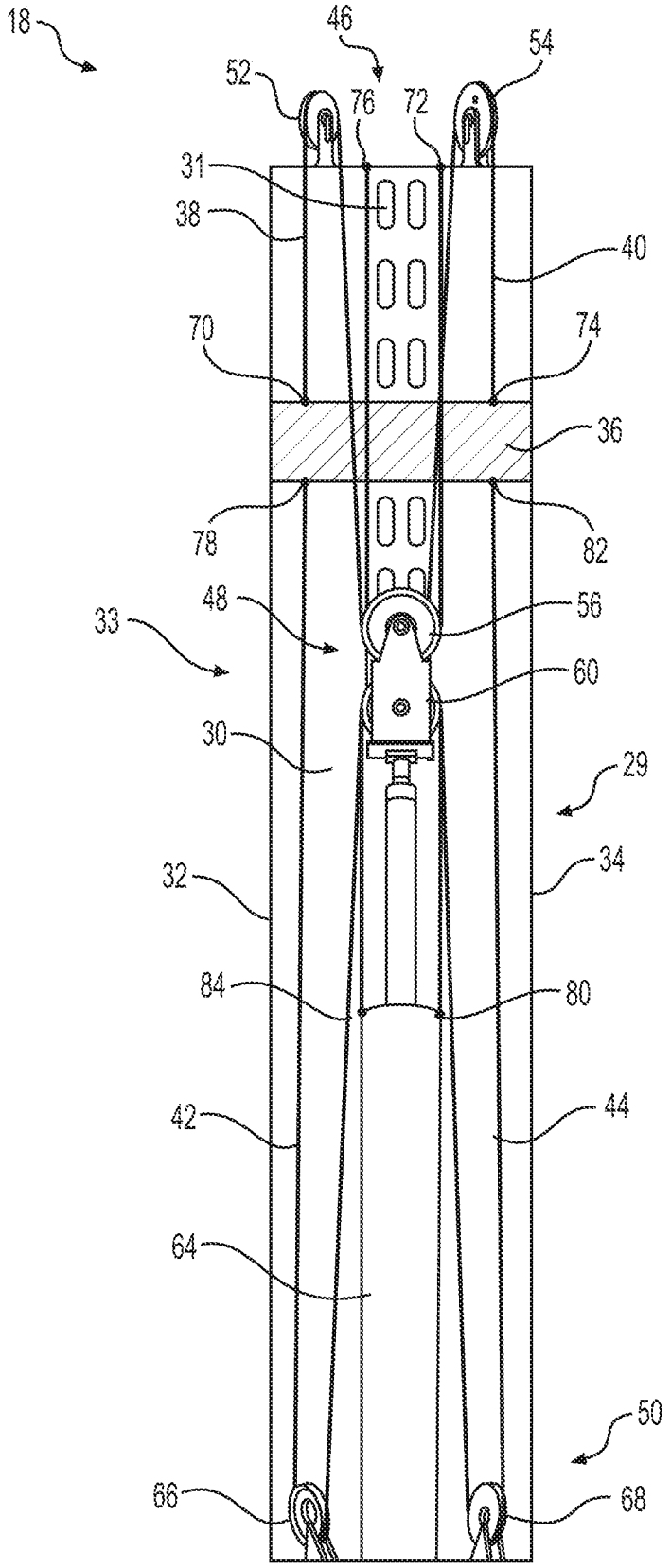
FIG. 2 illustrates a front, explanatory schematic view of an exemplary mast assembly isolated from the mobile drilling machine of FIG. 1.

FIG. 2 illustrates a front, explanatory schematic view of the mast assembly 18 of the mobile drilling machine 10. As shown in FIG. 2, the mast assembly 18 may include a mast frame 29 including a back 30, a first side 32, and a second side 34. The first side 32 and the second side 34 may diverge from the back 30 to form an open front 35 that has a larger width than the back 30 (as shown in FIG. 5B). With further reference to FIG. 5B, the first side 32 and the second side 34 may each extend at obtuse angles from an interior surface of the back 30 of mast frame 29. However, the first side 32 and the second side 34 also may be perpendicular to the back 30, such that the open front 35 may have the same width as the back 30. In addition, the mast frame 29 may be curved, such that the back 30, the first side 32, and the second side 34 form parts of a curve. As such, the mast frame 29 may be characterized as generally C-Shaped inasmuch as the shape of mast frame 20 is similar to and resembles the letter "C." Further, the open front 35 may be open along substantially an entire length of the mast frame 29 from top to bottom.

The back 30, the first side 32, and the second side 34 of the mast frame 29 may be formed by one or more plates. The one or more plates may include a plurality of plates that may extend substantially an entire length of the mast frame 29. The one or more plates may comprise any lightweight material, such as sheet metal and the like, to maintain structural rigidity of the mast frame 29, while reducing weight. Further, the one or more plates may include a plurality of cutouts 31 to further reduce weight. While only ten cutouts 31 are depicted in FIG. 2, it is understood the mast frame 29 may include more or less cutouts 31. As used herein, cutouts are weight-reducing holes, and do not include any holes in the one or more plates that serve a mechanical function, such as holes used for bolts and the like.

Mast assembly 18 may further comprise a drill motor assembly 36 (shown schematically as merely a rectangle in FIG. 2) movably attached to the mast frame 29. As will be discussed in more detail below, drill motor assembly 36 may rotate a drill pipe (not shown) such that the drill pipe rotates a drill bit (not shown) and drills through the ground surface, thus forming a blast hole in the ground surface. Drill motor assembly 36 may be driven up and down along a length of the mast frame 29 by a drill drive assembly 33. Drill drive assembly 33 may include a cable system, a sheave assembly, and a hydraulic cylinder 64. The cable system may comprise one or more of a first cable 38, a second cable 40, a third cable 42, and a fourth cable 44. First cable 38, second cable 40, third cable 42, and fourth cable 44 may each be attached to the inside of mast frame 29 and may be wound about the sheave assembly, as described below. The sheave assembly may comprise a plurality of sheaves including a top sheave assembly 46, a middle sheave assembly 48, and a bottom sheave assembly 50. The hydraulic cylinder 64 may extend generally parallel with the length of the mast frame 29.

Figure 3:
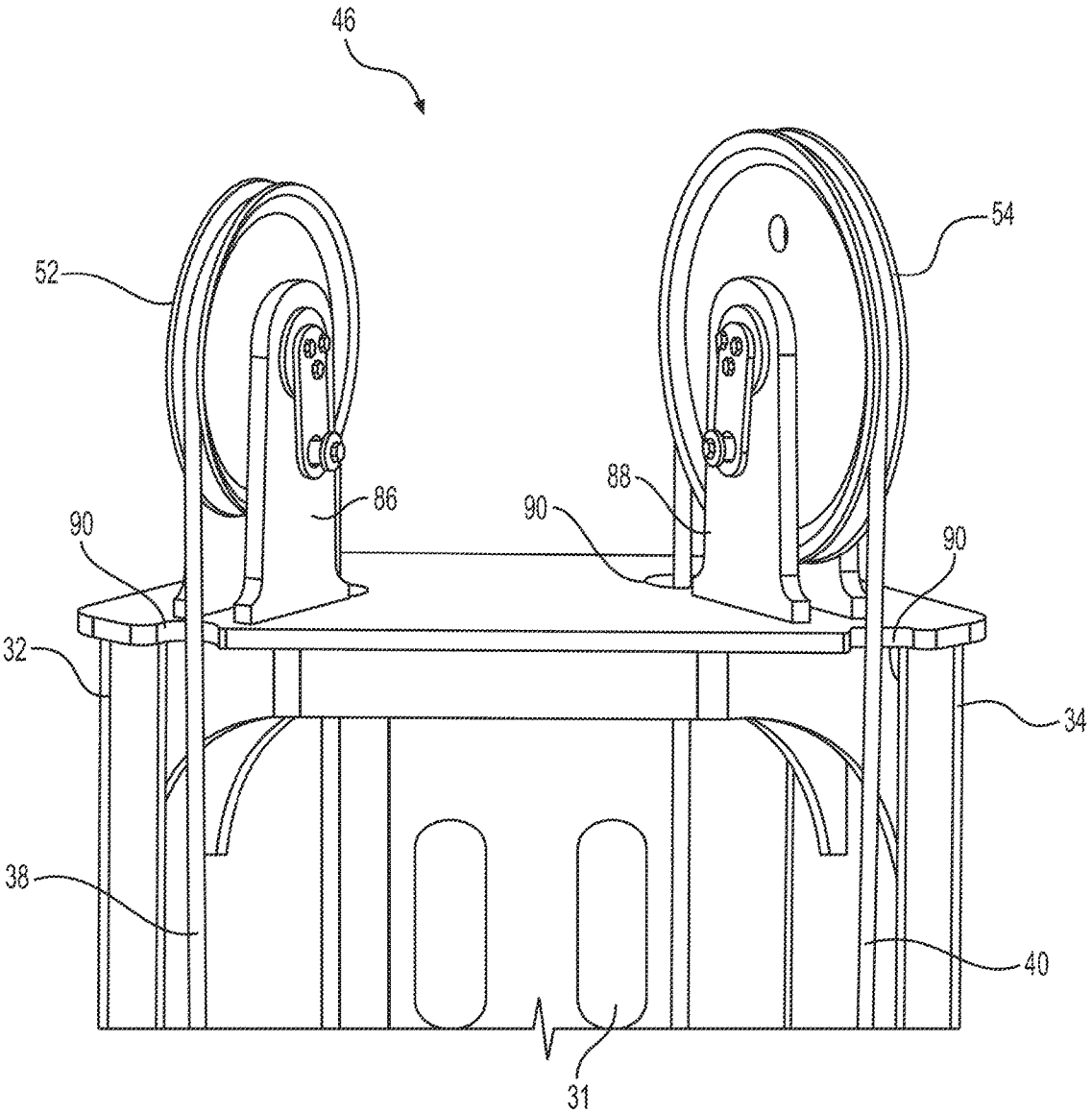
FIG. 3 illustrates an enlarged view of a top sheave assembly of the mast assembly of the mobile drilling machine of FIG. 1.

FIG. 3 illustrates an enlarged view of top sheave assembly 46 of the exemplary mast assembly 18. As shown in FIG. 3, top sheave assembly 46 may comprise a first sheave 52 and a second sheave 54. First sheave 52 may be rotatably mounted within a first bracket 86 and second sheave 52 may be rotatably mounted within a second bracket 88. The first and second brackets, 86 and 88, may be attached to a top of mast frame 29 by any attachment means known in the art, such as by welding and the like. First sheave 52 may be aligned generally parallel to the first side 32 of mast frame 29 and second sheave 54 may be aligned generally parallel to the second side 34 of mast frame 29. Aligning the first sheave 52 and the second sheave 54 in such a way may allow a more compact layout of the mast assembly 18, thus reducing weight. First sheave 52 may include an outer diameter and second sheave 54 may include an outer diameter, the outer diameter of the first sheave 52 may be less than the outer diameter of the second sheave 54. For example, the outer diameter of first sheave 52 may be fourteen (14) inches and the outer diameter of second sheave 54 may be eighteen (18) inches. As further shown in FIG. 3, first cable 38 may be wound about first sheave 52 and second cable 40 may be wound about second sheave 54. First cable 38 and second cable 40 may further be wound through respective holes 90 in the top of mast frame 29.

Figure 4B:
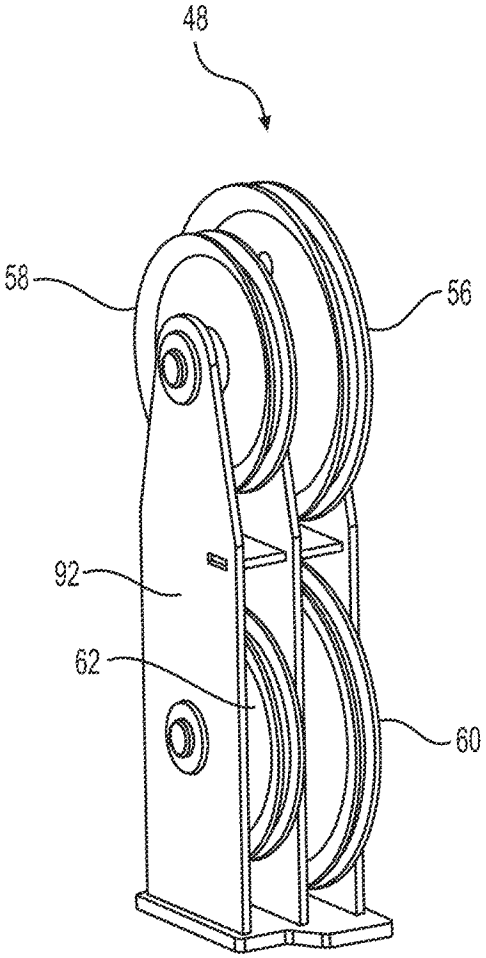
FIGS. 4A and 4B illustrate an enlarged view and a perspective view, respectively, of a middle sheave assembly of the mast assembly of the mobile drilling machine of FIG. 1.
Figure 4A:
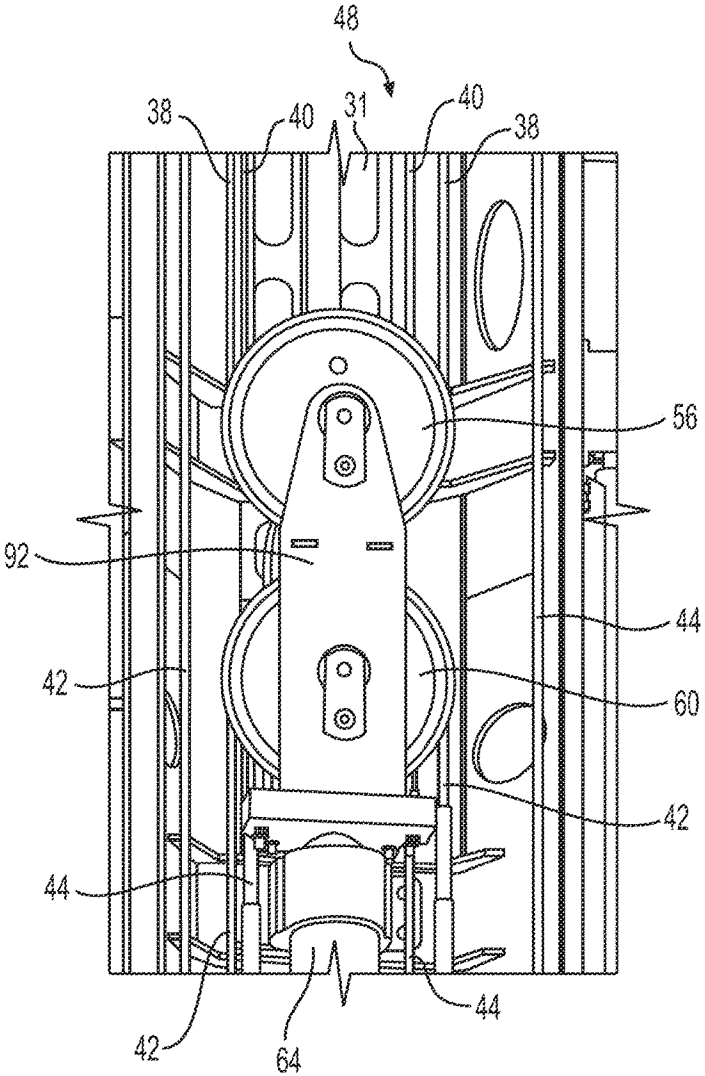

FIGS. 4A and 4B illustrate an enlarged view and a perspective view, respectively, of the middle sheave assembly 48. As shown in FIGS. 4A and 4B, middle sheave assembly 48 may comprise a third sheave 56, a fourth sheave 58, a fifth sheave 60, and a sixth sheave 62. The outer diameter of the fourth sheave 58 may be less than the outer diameter of the third sheave 56. For example, the outer diameter of fourth sheave 58 may be fourteen (14) inches and the outer diameter of the third sheave 56 may be eighteen (18) inches. Likewise, the outer diameter of the sixth sheave 62 may be less than the outer diameter of the fifth sheave 60. For example, the outer diameter of sixth sheave 62 may be fourteen (14) inches and the outer diameter of fifth sheave 60 may be eighteen (18) inches. Middle sheave assembly 48 may further comprise a third bracket 92. Third sheave 56 and fourth sheave 58 may be rotatably mounted within a top portion of third bracket 92 and fifth sheave 60 and sixth sheave 62 may be rotatably mounted within a bottom portion of third bracket 92. Third sheave 56 and fourth sheave 58 may be aligned parallel, or substantially parallel, to each other within third bracket 92. Likewise, fifth sheave 60 and sixth sheave 62 may be aligned parallel, or substantially parallel, to each other within third bracket 92. Further, third sheave 56 and fifth sheave 62 may be generally aligned and fourth sheave 58 and sixth sheave 62 may be generally aligned.

Third bracket 92 may be attached to hydraulic cylinder 64 such that middle sheave assembly 48 may be aligned generally parallel to back 30 of the mast frame 29. Third bracket 92 may be attached to a top of the hydraulic cylinder 64 by any known attachment means, such as by bolts and the like. Mounting of the middle sheave assembly 48 to the hydraulic cylinder 64 may allow middle sheave assembly 48 to move vertically within mast frame 29 when hydraulic cylinder 64 is actuated up and down. As further shown in FIG. 4A, first cable 38 may be wound about third sheave 56 and second cable 40 may be wound about fourth sheave 58. Likewise, third cable 42 may be wound about fifth sheave 60 and fourth cable 44 may be wound about sixth sheave 62.

Figure 5A:
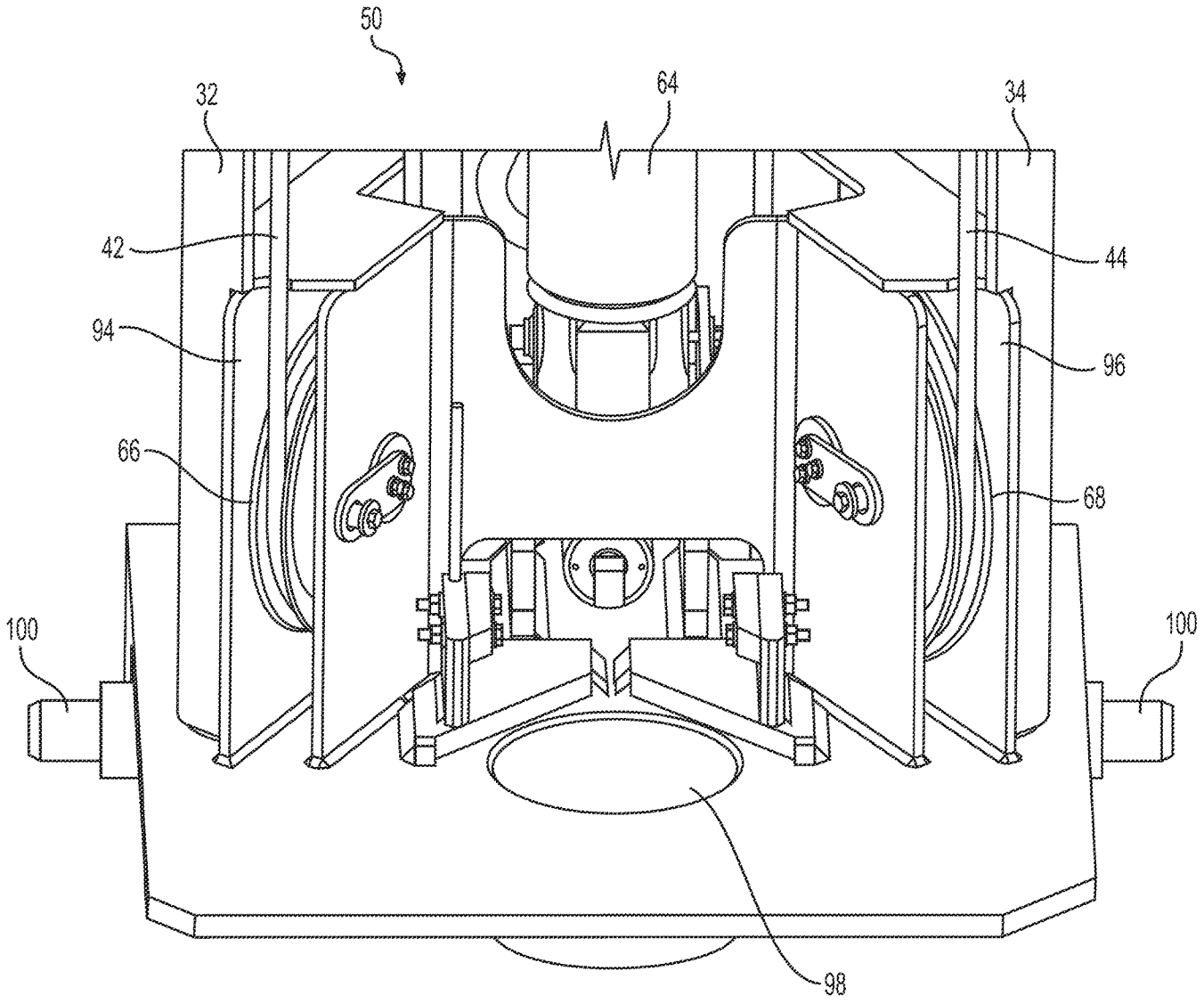
FIGS. 5A and 5B illustrate an enlarged view and a top view, respectively, of a bottom sheave assembly of the mast assembly of the mobile drilling machine of FIG. 1.
Figure 5B:
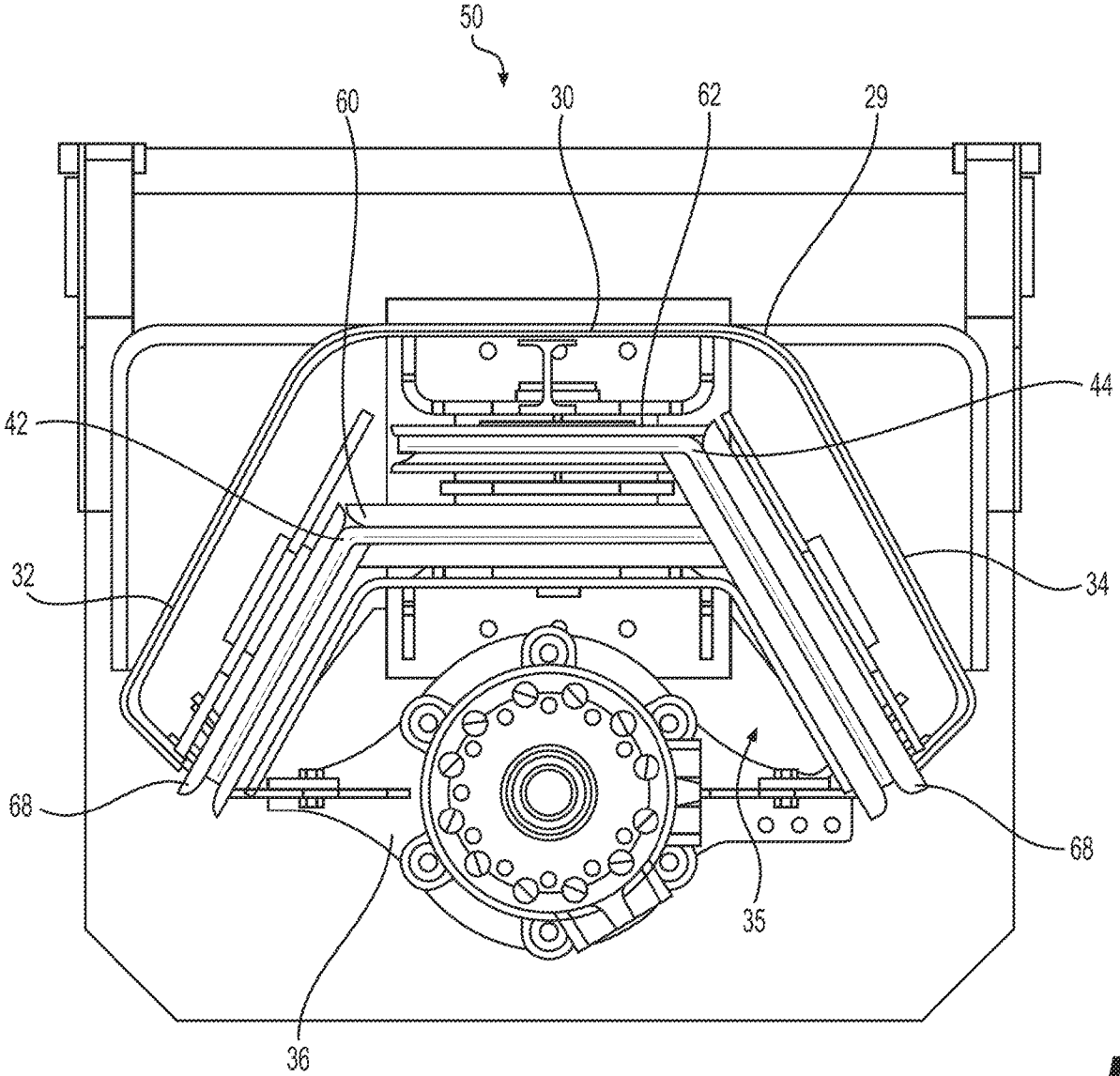

FIGS. 5A and 5B illustrate an enlarged view and a top view, respectively, of the bottom sheave assembly 50. As shown in FIGS. 5A and 5B, bottom sheave assembly 50 may comprise a seventh sheave 66 and an eighth sheave 68. Seventh sheave 66 may be rotatably mounted within a fourth bracket 94 and eighth sheave 68 may be rotatably mounted within a fifth bracket 96. The fourth and fifth brackets, 94 and 96, may be attached to a bottom of mast frame 29 by any attachment means known in the art, such as be welding and the like. Seventh sheave 66 may be aligned generally parallel to the first side 32 of mast frame 29 and eighth sheave 68 may be aligned generally parallel to the second side 34 of mast frame 29. Aligning the seventh sheave 66 and the eighth sheave 68 in such a way may allow a more compact layout of the mast assembly 18, thus reducing weight. The outer diameter of the seventh sheave 66 may be less than the outer diameter of the eighth sheave 68. For example, the outer diameter of the seventh sheave 66 may be fourteen (14) inches and the outer diameter of the eighth sheave 68 may be eighteen (18) inches. Third cable 42 may be wound about seventh sheave 66 and fourth cable 44 may be wound about eighth sheave 68. As further shown in FIG. 5B, third cable 42 may be wound about both the seventh sheave 66 of bottom sheave assembly 50 and the fifth sheave 60 of middle sheave assembly 48. Likewise, fourth cable 44 may be wound about both the eighth sheave 68 of bottom sheave assembly 50 and the sixth sheave 62 of middle sheave assembly 48.

As further shown in FIGS. 5A and 5B, the bottom of mast frame 29 may include a drill pipe hole 98 capable of receiving a drill pipe (not shown) on which the drill bit (not shown) is attached. The drill pipe may be removably attached to the drill motor assembly 36, such that the drill motor assembly 36 may drive/rotate the drill pipe to rotate the drill bit. The bottom of mast frame 29 may further include a locking mechanism, such as hydraulic pins 100. Hydraulic pins 100 may be extended such that they are inserted into lock holes 102 (FIG. 1) of coupling assembly 16 to lock mast assembly 18 into position for a drilling operation.

As described above, the sheave assembly may comprise a plurality of sheaves, each with an outer diameter. The outer diameter of the first sheave 52, the outer diameter of the fourth sheave 58, the outer diameter of the sixth sheave 62, and the outer diameter of the seventh sheave 66 may be approximately equal. Likewise, the outer diameter of the second sheave 54, the outer diameter of the third sheave 56, the outer diameter of the fifth sheave 60, and the outer diameter of the eighth sheave 68 may be approximately equal. Further, the outer diameter of the first sheave 52, the outer diameter of the fourth sheave 58, the outer diameter of the sixth sheave 62, and the outer diameter of the seventh sheave 66 may be less than the outer diameter of the second sheave 54, the outer diameter of the third sheave 56, the outer diameter of the fifth sheave 60, and the outer diameter of the eighth sheave 68. As such, the cable system may be wound about the sheave assembly such that each cable 38, 40, 42, and 44 may be wound about a sheave with a larger outer diameter and a sheave with a smaller outer diameter.

With reference to FIGS. 2, 3, and 4A-4B, first cable 38 may be attached by a first end to drill motor assembly 36 at a first attachment point 70. First cable 38 may be wound about first sheave 52 of top sheave assembly 46 and third sheave 56 of middle sheave assembly 48. At its other end, first cable 38 may be attached to mast frame 29 at a second attachment point 72. Second cable 40 may be attached by a first end to drill motor assembly 36 at a third attachment point 74. Second cable 40 may be wound about second sheave 54 of top sheave assembly 46 and fourth sheave 58 of middle sheave assembly 48. At its other end, second cable 40 may be attached to mast frame 29 at a fourth attachment point 76.

With reference to FIGS. 2, 4A-4B, and 5A-5B, third cable 42 may be attached by a first end to drill motor assembly 36 at a fifth attachment point 78. Third cable 42 may be wound about seventh sheave 66 of bottom sheave assembly 50 and fifth sheave 60 of middle sheave assembly 48. At its other end, third cable 42 may be attached to hydraulic cylinder 64 at a sixth attachment point 80. Fourth cable 44 may be attached by a first end to drill motor assembly 36 at a seventh attachment point 82. Fourth cable 44 may be wound about eighth sheave 68 of bottom sheave assembly 50 and sixth sheave 62 of middle sheave assembly 48. At its other end, fourth cable 44 may be attached to hydraulic cylinder 64 at an eighth attachment point 84.

INDUSTRIAL APPLICABILITY

The disclosed aspects of mast assembly 18 may be used by any mobile drilling machine 10.

During operation, an operator in the operator cab 24 may raise the mast assembly 18 to a desired drilling angle position (e.g., $\theta_1$ or $\theta_2$) by extending the one or more actuators 28 using a control in the operator cab 24. Mast assembly 18 may be rotated about a pivot 26 within coupling assembly 16. When the desired drilling angle position is reached, mast assembly 18 may be locked into position by extending hydraulic pins 100 (FIG. 5A) into a respective lock hole 102 of the coupling assembly 16. The operator may then lower the drill motor assembly 36 for a drilling operation. Movement of the drill motor assembly 36 is initiated by the hydraulic cylinder 64. The hydraulic cylinder 64 may raise and lower the middle sheave assembly 48, such that the first cable 38, second cable 40, third cable 42, and fourth cable 44 may either pull-down or hoist up the drill motor assembly 36. For example, to lower the motor assembly 36, and cause the drill bit (not shown) to be lowered during the drilling operation, middle sheave assembly 48 may be raised by the hydraulic cylinder 64. When the middle sheave assembly 48 is raised by the hydraulic cylinder 64, third cable 42 and fourth cable 44 may be put into tension, thus pulling the drill motor assembly 36 downward. Conversely, to raise the drill motor assembly 36, and cause the drill bit to be raised during the drilling operation, middle sheave assembly 48 may be lowered by the hydraulic cylinder 64. When middle sheave assembly 48 is lowered by the hydraulic cylinder 64, first cable 38 and second cable 40 may be put into tension, thus hoisting the motor assembly 36 upward.

The exemplary mast assembly 18 of mobile drilling machine 10 may provide for a compact and lightweight system that facilitates positioning of the mast assembly 18 at a negative angle. The mast frame 29 comprising one or more plates with diverging sides, an open front, and cutouts may allow for a lightweight mast assembly 18 while maintaining structural rigidity. Such a mast frame 29 provides for angling of the first sheave 52 and the second sheave 54 and angling of the seventh sheave 66 and the eighth sheave 68, as described above. Further, angling the sheaves in such a way may facilitate interconnection of the cables from the top sheave assembly to the middle sheave assembly and from the bottom sheave assembly to the middle sheave assembly. Further, the different outer diameters of the sheaves may also allow for a more compact mast assembly 18, while maintaining sheave-cable ratios. For example, the cable system may be wound about the sheave assembly such that each cable 38, 40, 42, and 44 may be wound about a sheave with a larger outer diameter and a sheave with a smaller outer diameter. This may facilitate appropriate sheave-cable ratios to allow for sufficient strength and life of the cables.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A mast assembly for a mobile drilling machine, comprising:

a mast frame including a back, a first side, and a second side, the first side and the second side diverging from the back to form an open front along substantially an entire length of the mast frame;

a drill motor assembly movably attached to the mast frame, wherein the drill motor assembly is configured to rotate a drill pipe; and a drill drive assembly configured to drive the motor assembly up and down along a length of the mast frame, the drill drive assembly including:

a sheave assembly comprising a plurality of sheaves, wherein the plurality of sheaves include a first sheave aligned generally parallel to the first side of the mast frame and a second sheave aligned generally parallel to the second side of the mast frame, the plurality of sheaves further include a third sheave, a fourth sheave, a fifth sheave, a sixth sheave, a seventh sheave and an eight sheave;

a hydraulic cylinder extending generally parallel with the mast frame, wherein the third sheave, the fourth sheave, the fifth sheave, and the sixth sheave are located on the hydraulic cylinder, the seventh sheave is aligned generally parallel to the first side of the mast frame and the eighth sheave aligned generally parallel to the second side of the mast frame; and a first cable, a second cable, a third cable, and a fourth cable, wherein the first cable is wound about the first sheave and the third sheave, the second cable is wound about the second sheave and the fourth sheave, the third cable is wound about the seventh sheave and the fifth sheave, and the fourth cable is wound about the eighth sheave and the sixth sheave.

2. The mast assembly of claim 1, wherein the back, first side, and second side are formed by one or more plates.

3. The mast assembly of claim 2, wherein the one or more plates include a plurality of plates extending substantially the entire length of the mast frame.

4. The mast assembly of claim 2, wherein the one or more plates each includes a plurality of cutouts.

5. The mast assembly of claim 1, wherein the first side of the mast frame and the second side of the mast frame each extend at obtuse angles from an interior surface of the back of the mast frame.

6. The mast assembly of claim 1, wherein the first sheave and the second sheave are located at a top of the mast frame, and wherein the first sheave includes an outer diameter and the second sheave includes an outer diameter, the outer diameter of the first sheave being less than the outer diameter of the second sheave.

7. The mast assembly of claim 6, wherein the third sheave includes an outer diameter, the fourth sheave includes an outer diameter, the fifth sheave includes an outer diameter, and the sixth sheave includes an outer diameter, the outer diameter of the fourth sheave being less than the outer diameter of the third sheave and the outer diameter of sixth sheave being less than the outer diameter of the fifth sheave.

8. The mast assembly of claim 7, wherein the seventh sheave and the eighth sheave are each located at a bottom of the mast frame, and wherein the seventh sheave includes an outer diameter and the eighth sheave includes an outer diameter, the outer diameter of the seventh sheave being less than the outer diameter of the eighth sheave.

9. The mast assembly of claim 8, wherein the outer diameter of the first sheave, the outer diameter of the fourth sheave, the outer diameter of the sixth sheave, and the outer diameter of the seventh sheave are approximately equal, and wherein the outer diameter of the second sheave, the outer diameter of the third sheave, the outer diameter of the fifth sheave, and the outer diameter of the eighth sheave are approximately equal.

10. The mast assembly of claim 1, wherein the mast is pivotable on each side of a vertical orientation to allow for a negative angle drilling operation.

11. A negative angle drilling assembly for a mobile drilling machine, comprising:

a mast configured to pivot to each side of a vertical orientation, the mast comprising:

a mast frame including a back, a first side, and a second side, the first side and the second side diverging from the back to form an open front along substantially an entire length of the mast frame;

a drill motor assembly movably attached to the mast frame, wherein the drill motor assembly is configured to rotate a drill pipe; and a drill drive assembly configured to drive the drill motor assembly up and down along a length of the mast frame, the drill drive assembly including:

a sheave assembly comprising a plurality of sheaves, wherein the plurality of sheaves include a first sheave aligned generally parallel to the first side of the mast frame and a second sheave aligned generally parallel to the second side of the mast frame, the plurality of sheaves further include a third sheave, a fourth sheave, a fifth sheave, a sixth sheave, a seventh sheave and an eight sheave;

a hydraulic cylinder extending generally parallel with the length of the mast frame, wherein the third sheave, the fourth sheave, the fifth sheave, and the sixth sheave are located on the hydraulic cylinder, the seventh sheave is aligned generally parallel to the first side of the mast frame and the eighth sheave aligned generally parallel to the second side of the mast frame; and a first cable, a second cable, a third cable, and a fourth cable, wherein the first cable is wound about the first sheave and the third sheave, the second cable is wound about the second sheave and the fourth sheave, the third cable is wound about the seventh sheave and the fifth sheave, and the fourth cable is wound about the eighth sheave and the sixth sheave.

12. The negative angle drilling assembly of claim 11, wherein the first side of the mast frame and the second side of the mast frame each extend at obtuse angles from an interior surface of the back of the mast frame.

13. The negative angle drilling assembly of claim 12, wherein the first sheave and the second sheave are located at a top of the mast frame, and wherein the first sheave includes an outer diameter and the second sheave includes an outer diameter, the outer diameter of the first sheave being less than the outer diameter of the second sheave.

14. The negative angle drilling assembly of claim 13, wherein the third sheave includes an outer diameter, the fourth sheave includes an outer diameter, the fifth sheave includes an outer diameter, and the sixth sheave includes an outer diameter, the outer diameter of the fourth sheave being less than the outer diameter of the third sheave and the outer diameter of sixth sheave being less than the outer diameter of the fifth sheave.

15. The negative angle drilling assembly of claim 14, wherein the seventh sheave and the eighth sheave are each located at a bottom of the mast frame, and wherein the seventh sheave includes an outer diameter and the eighth sheave includes an outer diameter, the outer diameter of the seventh sheave being less than the outer diameter of the eighth sheave.

16. A mast assembly for a mobile drilling machine, comprising:

a mast configured to pivot to each side of a vertical orientation to allow for a negative angle drilling operation, the mast comprising:

a mast frame including a back, a first side, and a second side, the first side and the second side diverging from the back to form an open front that is larger than the back, wherein the back, the first side, and the second side are formed by one or more plates extending substantially an entire length of the mast frame;

a drill motor assembly movably attached to the mast frame, wherein the motor assembly is configured to rotate a drill pipe; and a drill drive assembly configured to drive the drill motor assembly up and down along a length of the mast frame, the drill drive assembly including:

a hydraulic cylinder extending generally parallel with the length of the mast frame;

a sheave assembly comprising a first sheave, a second sheave, a third sheave, a fourth sheave, a fifth sheave, a sixth sheave, a seventh sheave, and an eighth sheave, wherein the first sheave and the second sheave are located at a top of the mast frame, the first sheave is aligned generally parallel to the first side of the mast frame and the second sheave is aligned generally parallel to the second side of the mast frame, and the first sheave includes an outer diameter and the second sheave includes an outer diameter, the outer diameter of the first sheave being less than the outer diameter of the second sheave, wherein the third sheave, the fourth sheave, the fifth sheave, and the sixth sheave are located on the hydraulic cylinder, the third sheave includes an outer diameter, the fourth sheave includes an outer diameter, the fifth sheave includes an outer diameter, and the sixth sheave includes an outer diameter, the outer diameter of the fourth sheave being less than the outer diameter of the third sheave and the outer diameter of the sixth sheave being less than the outer diameter of the fifth sheave, wherein the seventh sheave and the eighth sheave are located at a bottom of the mast frame, the seventh sheave is aligned generally parallel to the first side of the mast frame and the eighth sheave is aligned generally parallel to the second side of the mast frame, and the seventh sheave includes an outer diameter and the eighth sheave includes an outer diameter, the outer diameter of the seventh sheave being less than the outer diameter of the eighth sheave; and a first cable, a second cable, a third cable, and a fourth cable, wherein the first cable is wound about the first sheave and the third sheave, the second cable is wound about the second sheave and the fourth sheave, the third cable is wound about the seventh sheave and the fifth sheave, and the fourth cable is wound about the eighth sheave and the sixth sheave.

17. The mast assembly of claim 16, wherein the first side of the mast frame and the second side of the mast frame each extend at obtuse angles from an interior surface of the back of the mast frame.

* * * * *